US005574244A

United States Patent [19]

Powell et al.

[11] Patent Number: 5,574,244

[45] Date of Patent: Nov. 12, 1996

[54] HYPERVELOCITY CUTTING MACHINE AND METHOD

[75] Inventors: James R. Powell, Shoreham; Morris Reich, Queens, both of N.Y.

[73] Assignee: Associated Universities, Inc., Washington, D.C.

[21] Appl. No.: 340,537

[22] Filed: Nov. 16, 1994

[51] Int. Cl.[6] ..... F41A 1/04

[52] U.S. Cl. ..... 89/7; 102/520

[58] Field of Search ..... 89/7; 173/200, 173/206, 138; 227/10; 102/521, 520

[56] References Cited

U.S. PATENT DOCUMENTS

| | | | |
|---|---|---|---|
| 2,841,365 | 1/1958 | Ramsey et al. | 255/1.8 |
| 2,868,509 | 1/1959 | Williams | 255/61 |
| 3,521,523 | 7/1970 | Van Langenhoven | 89/7 |
| 3,863,723 | 2/1975 | Godfrey | 175/4.5 |
| 4,074,858 | 2/1978 | Burns et al. | 239/172 |
| 4,161,133 | 7/1979 | Black et al. | 89/7 |
| 4,337,685 | 7/1982 | Munding et al. | 89/7 |
| 4,419,935 | 12/1983 | Shibukawa | 102/313 |
| 4,534,427 | 8/1985 | Wang et al. | 175/67 |
| 4,761,037 | 8/1988 | Medeot | 299/1 |
| 4,795,217 | 1/1989 | Hilaris | 299/36 |
| 5,005,484 | 4/1991 | Witt | 102/501 |
| 5,429,030 | 7/1995 | Tidman | 89/7 |

FOREIGN PATENT DOCUMENTS

| | | | |
|---|---|---|---|
| 3016181 | 11/1981 | Germany | 89/7 |
| 3016272 | 11/1981 | Germany | 89/7 |
| 4139394 | 5/1992 | Japan | 89/7 |

OTHER PUBLICATIONS

The Evening Star, Mar. 29, 1956, p.A–2, 89/7.

*Primary Examiner*—Stephen M. Johnson
*Attorney, Agent, or Firm*—Margaret C. Bogosian

[57] ABSTRACT

A method and machine 14 are provided for cutting a workpiece 12 such as concrete. A gun barrel 16 is provided for repetitively loading projectiles 22 therein and is supplied with a pressurized propellant from a storage tank 28. A thermal storage tank 32,32A is disposed between the propellant storage tank 28 and the gun barrel 16 for repetitively receiving and heating propellant charges which are released in the gun barrel 16 for repetitively firing projectiles 22 therefrom toward the workpiece 12. In a preferred embodiment, hypervelocity of the projectiles 22 is obtained for cutting the concrete workpiece 12 by fracturing thereof.

31 Claims, 9 Drawing Sheets

HYPERVELOCITY CUTTING MACHINE AND METHOD

This invention was made with Government support under contract number DE-AC02-76CH00016, between the U.S. Department of Energy and Associated Universities, Inc. The Government has certain rights in the invention.

The present invention relates generally to cutting machines, and, more specifically, to a machine using hypervelocity projectiles for cutting a workpiece.

BACKGROUND OF THE INVENTION

In order to cut concrete, both regular and steel reinforced, conventional jackhammers and abrasive cutting saws are utilized. The resulting cutting processes are relatively slow and labor intensive and therefore have a correspondingly high expense. Furthermore, considerable concrete dust is generated during the processes which is a significant problem when radioactive hot cells and processing canyon structures need to be razed. Radioactive hot cells are used in the nuclear industry for various functions in the handling and manufacturing of radioactive nuclear fuel. When the cells become obsolete, they must be removed from service and suitably dismantled and safely stored. The use of conventional jackhammers and abrasive cutting saws therefore present a substantial problem in safety since prolonged exposure to radiation is undesirable, and the release of radioactive dust must be contained.

Similar problems exist for cutting non-radioactive concrete such as found in roads when access to underground pipe is required, or in bridge repair where road beds and support structures must be replaced. And, tunneling and mining operations also typically require cutting of stone using jackhammers, saws, and drilling bits along with other types of equipment. Associated with all these cutting methods is high noise levels which is also a problem.

SUMMARY OF THE INVENTION

A method and machine are provided for cutting a workpiece such as concrete. A gun barrel is provided having means for repetitively loading projectiles therein and is supplied with a pressurized propellant gas from a storage tank. A thermal storage tank is disposed between the propellant storage tank and the gun barrel for repetitively receiving and heating the propellant gas charges which are subsequently released in the gun barrel for repetitively firing projectiles therefrom toward the workpiece. In a preferred embodiment, hypervelocity of the projectiles is obtained for cutting the concrete workpiece by fracturing along a predetermined line or cutting pattern.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
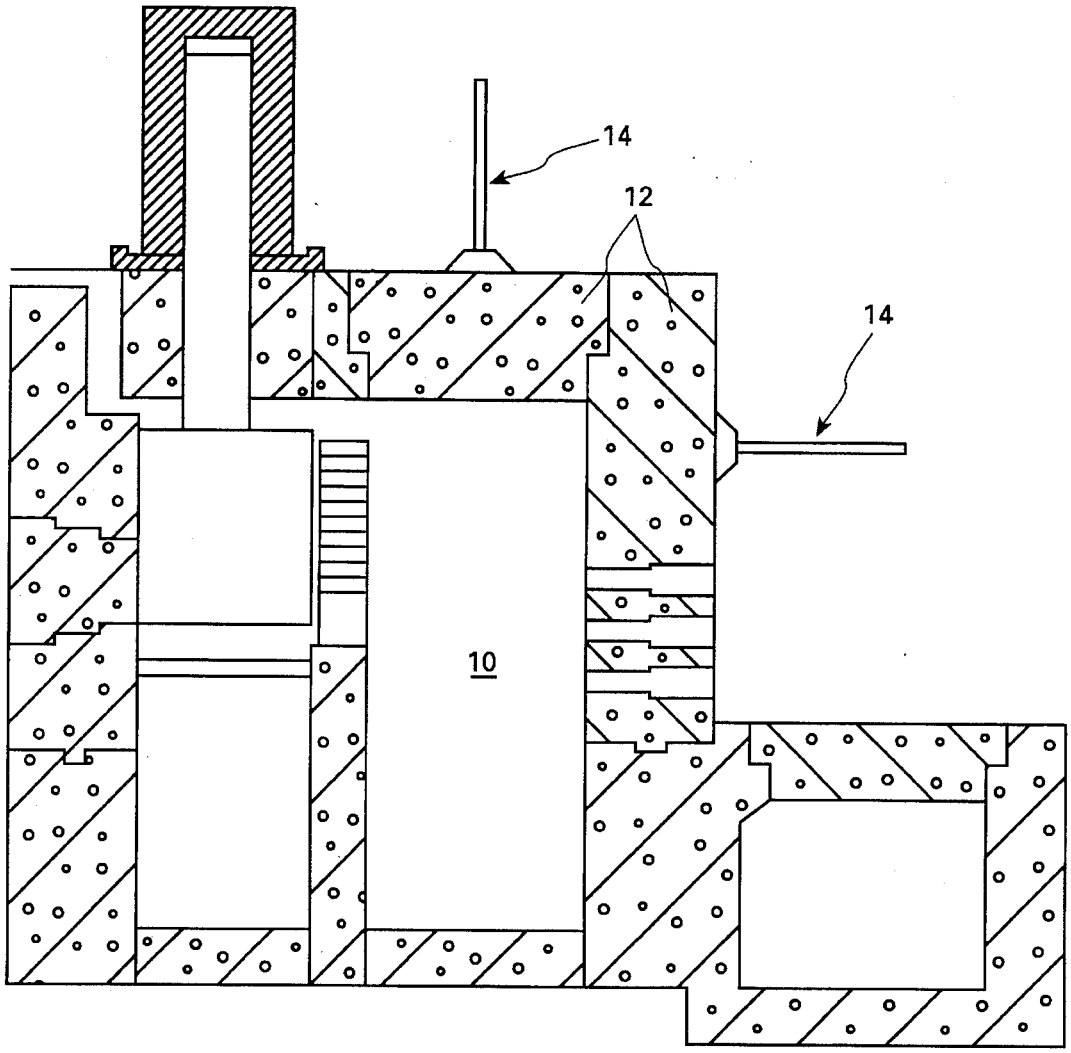
FIG. 1 is an elevational sectional view through an exemplary radioactive hot cell having concrete partitions to be cut using a cutting machine in accordance with the present invention a portion of which is schematically illustrated in vertical and horizontal cutting positions therein.

Illustrated in FIG. 1 is a portion of an exemplary radioactive hot cell 10 which is formed of various, steel reinforced concrete slabs 12 which form the walls, floors and ceilings thereof. Shown schematically are two substantially identical cutting machines 14 in accordance with the present invention which may be suitably positioned adjacent to the various concrete slabs 12 which form workpieces which require cutting in order to be dismantled.

Figure 2:
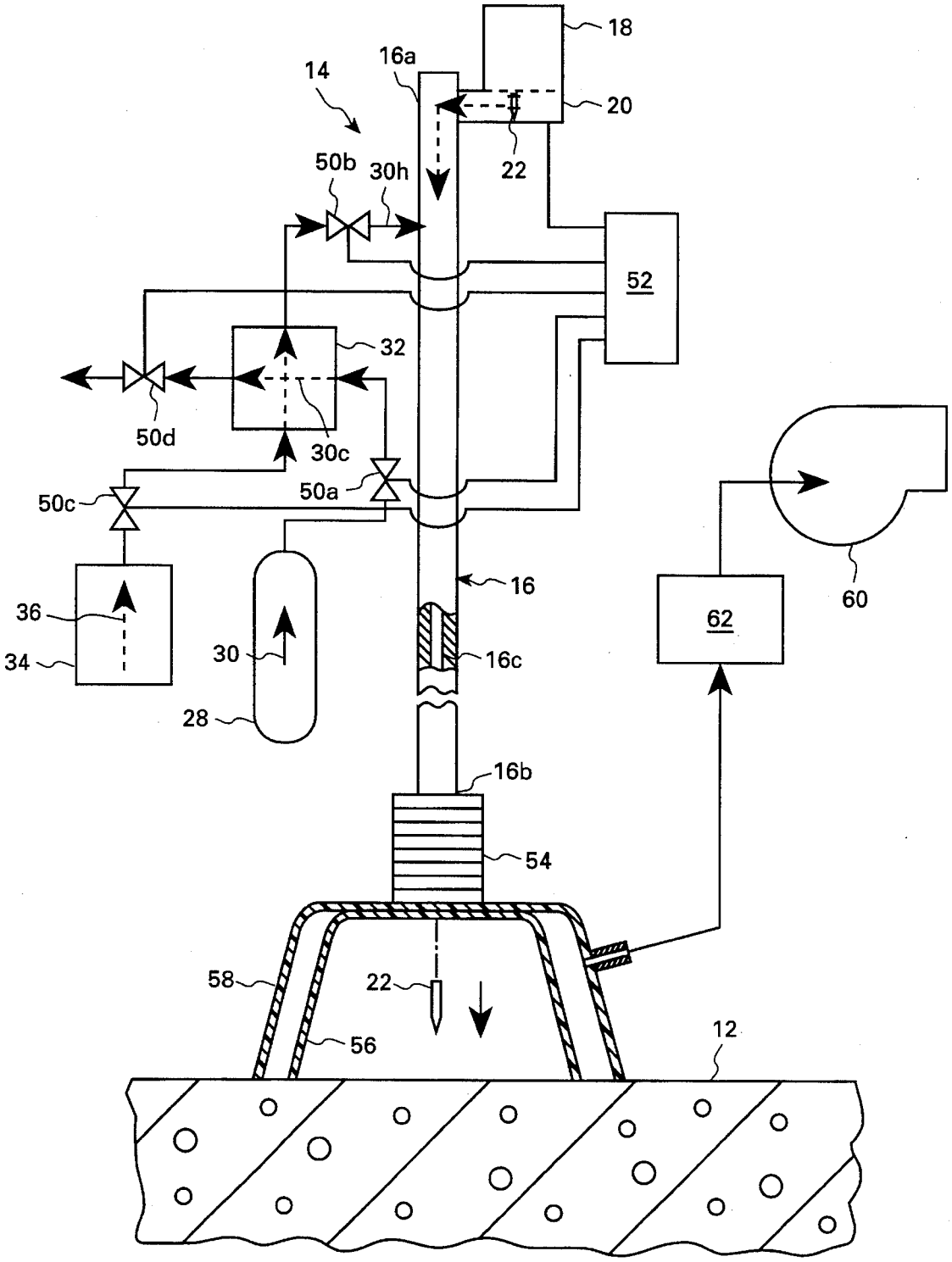
FIG. 2 is a schematic representation of the cutting machine illustrated in FIG. 1 shown in an exemplary configuration including a gun barrel, a projectile loading magazine, and a thermal storage tank.

An exemplary embodiment of the cutting machine 14 is illustrated in more particularity in FIG. 2 resting on the workpiece 12, which in this exemplary embodiment is a steel reinforced slab of concrete. Although the cutting machine 14 is being disclosed specifically for cutting the concrete workpiece 12, it may be suitably adapted for cutting other materials as desired. In cutting concrete, and the enclosed steel or other reinforcement, the cutting machine 14 is referred to as a RAPid cuTter Of concRete (RAPTOR) which by name implies the ability to rapidly cut regular or reinforced concrete as compared to conventional techniques using jackhammers or abrasive cutting saws. The RAPTOR machine 14 includes an elongate steel gun barrel 16 having a loading end **16*a* at its top and an opposite firing end 16*b* at its bottom, and a suitable cylindrical bore 16*c* extending therebetween. Means in the form of a magazine 18 and automatic loader 20 are provided for repetitively supplying or loading specially configured projectiles 22 into the barrel loading end 16*a*** in sequence.

Figure 3:
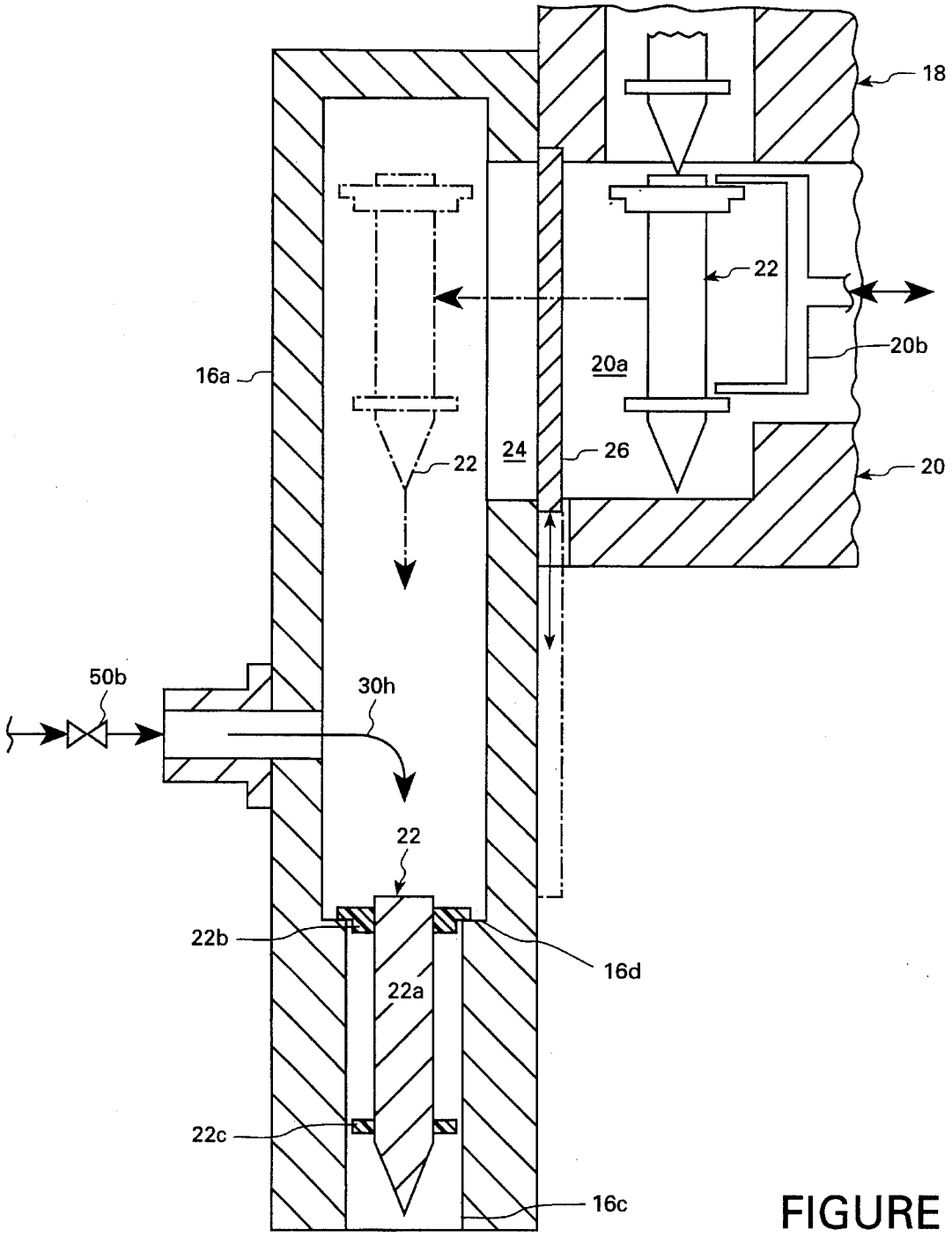
FIG. 3 is an enlarged, partly sectional view of the loading end of the gun barrel illustrated in FIG. 2 showing an exemplary embodiment of the loading magazine in more detail.

As shown in more particularity in FIG. 3, the magazine 18 is suitably configured for storing a plurality of the projectiles 22, for example several hundred thereof, and is suitably attached to the barrel loading end **16*a*. The loader 20 is operatively joined to the bottom of the magazine 18 and to the barrel loading end 16*a* for selectively repetitively loading the projectiles 22 in turn into the barrel loading end 16*a*. In an exemplary embodiment, the barrel loading end 16*a* has a loading passage 24 in the wall thereof aligned with a complementary passage 20*a* of the loader 20**. A loading slide 26 is suitably mounted for selectively opening and closing the loading passage 24 for allowing loading therein of individual ones of the projectile 22 in turn. When the loading slide 26 is open, one of the projectiles 22 may be simply inserted into the barrel loading end 16 by a suitable loading shuttle 20*b* which is translated back and forth by an electrically actuated solenoid for example. In this way, projectiles 22 from the magazine 18 may be loaded repetitively in turn into the barrel loading end 16*a*. Other configurations of the magazine 18 and loader 20 may be used as desired.

FIG. 3 also illustrates an exemplary embodiment of the projectile 22 in the form of a solid cylindrical steel rod 22*a* and a pair of spaced apart plastic sabots 22*b*, 22*c* suitably fixedly joined to opposite ends of the rod 22*a*. The rod 22*a* preferably has a sharply pointed, V-shaped distal end as its leading end. The projectile 22 is relatively lightweight and may have a mass of up to about 2.5 grams for example so that it may be readily accelerated to hypervelocity preferably greater than about 914 meters per second (m/s), i.e. about 3,000 feet per second (fps). Hypervelocity is typically a speed greater than the velocity achievable from firing projectiles using conventional explosive gun powders. The operator of a RAPTOR cutter will be able to select the velocity of the projectiles 22 that are being fired so that the velocity is appropriate for the composition and the thickness of the material being cut. The projectile velocity is proportional to the gas pressure in the barrel bore 16*c*, which can be suitably adjusted by the operator.

The length of the projectile 22 is preferably within the range of about 25 mm (1 inch) to about 37 mm (1.5 inch), but not limited thereto, with the rod 22*a* having a nominal diameter of about 3.2 mm (⅛ inch), and the sabots 22*b,c* having nominal outer diameters of about 6.4 mm (¼ inch). As shown in FIG. 3, the top sabot 22*b* includes a slightly larger outer retaining flange or fingers configured for resting on a suitable step 16*d* in the barrel bore 16*c* for temporarily supporting the projectile 22 prior to firing. Upon firing of the projectile 22, the retaining flange of the top sabot 22*b* is simply broken off, and it is likely that both sabots 22*b,c* will also be broken off upon discharge from the gun barrel 16. The diameter of the bore 16*c* is suitably larger than and closely matches the nominal diameter of the sabots 22*b,c* and may be about 7.6 mm (0.3 inch) for example, so that gas leakage around the projectile 22 is minimized.

Accordingly, a non-gun powder propellant is desired for achieving suitable hypervelocities for cutting the concrete workpiece 12 by fracturing thereof and for allowing relatively quick, repetitive firing of the projectiles 22 in order to achieve suitably fast cutting. More specifically, a conventional metal bottle or tank 28 as shown in FIG. 2 is provided for storing a pressurized gaseous propellant 30 at room temperature, or the prevailing environmental temperature for ensuring safe storage thereof. The propellant 30 may be any suitable gas such as nitrogen or helium, with lower molecular weight gases being preferred for achieving higher velocities of the projectiles 22. The propellant 30 may be safely stored in the tank 28 at relatively high conventional storage pressures of about 14 megapascal (MPa), or about 2,000 psi.

A thermal storage tank 32 as shown in FIG. 2 is joined in flow communication with the propellant tank 28 by a suitable conduit for repetitively receiving therefrom a propellant portion or charge 30*c* and heating the propellant charge 30*c*. The thermal tank 32 is also joined in flow communication by a suitable conduit with the barrel loading end 16*a* for delivering the heated propellant charge 30*h* thereto.

Means are provided for controlling repetitive delivery of the projectiles 22 to the barrel 16, the propellant charge 30*c* from the propellant tank 28 to the thermal tank 32, and the heated propellant charge 30*h* from the thermal tank 32 to the barrel 16 for repetitively firing the projectiles 22 from the barrel firing end 16*b* toward the workpiece 12 for cutting thereof.

In an exemplary embodiment, the gun barrel 16 is about 1.5 meters in length, the mass of the projectile 22 is about 2.5 grams, the propellant 30 is helium and is heated in the thermal storage tank 32 to about 1,500° K. for achieving a projectile firing or driving pressure within the barrel 16 of about 84 Mpa (12,000 psi), with a resulting velocity of the projectile 22 of about 1.5 km/s (about 5,000 feet per second). This drive pressure is substantially less than the pressure obtained in conventional explosive powder guns which typically operate at maximum pressures in the range of about 280–420 MPa (40,000 to 60,000 psi). And, the temperature of propellant gases in conventional guns is considerably higher at about 2,500° K. The lower temperature and chemically non-reactive nature of the helium propellant 30 used in the RAPTOR machine 14 will enable the barrel 16 to fire many more rounds than conventional gun barrels before erosion and other types of damage occur. RAPTOR barrels 16 should be capable of firing many thousands of projectiles 22 before replacement becomes necessary. The design parameters of RAPTOR, e.g. drive pressure, barrel length, barrel diameter, and projectile length & mass, can be chosen to give a very wide range of projectile velocities up to, and even in excess of, 9140 m/s (10,000 fps) if desired.

The thermal storage tank 32 illustrated in FIG. 2 provides an effective manner for repetitively heating the room temperature propellant 30 received from the propellant tank 28 for obtaining relatively quick repetitive firing of successive projectiles 22 at a rate, for example, of 1 to 2 shots per second. In order to recharge the thermal tank 32, means in the form of a conventional heater such as a propane combustion burner 34 are provided for generating hot combustion gases 36 which are affective for periodically or repetitively heating and reheating the thermal tank 32 after a predetermined number of propellant charges 30*c* collectively remove a predetermined amount of heat therefrom.

Figure 4:
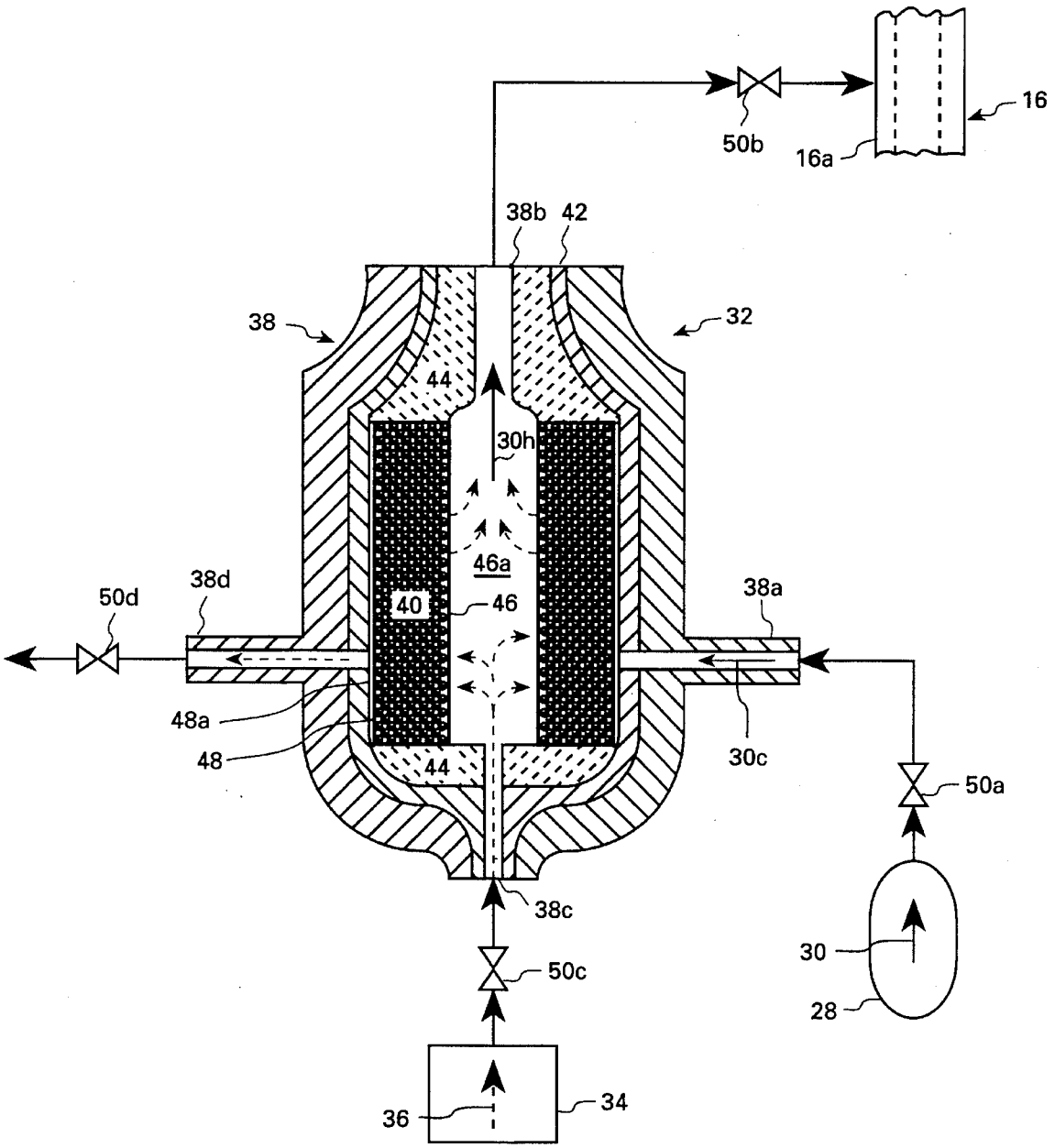
FIG. 4 is a schematic sectional view of the thermal storage tank illustrated in FIG. 2.

As shown more specifically in FIG. 4, a preferred embodiment of the thermal tank 32 includes a housing or pressure vessel 38 which is preferably lightweight and may be formed of a suitable metal or graphite and epoxy. Contained inside the housing 38 is a tubular, porous thermal storage bed 40 for storing heat received from the heater 34 and for releasing the heat as required into the propellant charges 30*c* as they flow therethrough. Any suitable material such as 1 mm Zirconia particles or pellets may be used for the thermal bed 40 for retaining and releasing heat as required during operation. Disposed radially between the housing 38 and the bed 40 is an annular liner 42 having suitable cooling passages therethrough (not shown) in which may be circulated a cooling fluid such as water so that the outside of the thermal tank 32 may be maintained at a low temperature. Disposed inside the liner 42 and at both opposite axial ends of the thermal bed 40 are suitable thermal insulators 44 such as ceramic fiber mat for containing the heat within the thermal bed 40.

The thermal bed 40 is supported between a radially inner porous tube 46 which is preferably a ceramic such as silicon carbide, and a radially outer porous tube 48 which may be stainless steel for example. The inner tube 46 defines an empty inner chamber 46*a*, and the outer tube 48 is spaced radially inwardly from an intermediate portion of the liner 42 to define an empty annular outer chamber 48*a*. The inner tube 46 is preferably porous for allowing gas flow therethrough and may be in the form of a conventionally porous ceramic, or suitable holes may be drilled therethrough. The outer tube 48 is similarly porous for allowing gas flow therethrough and is preferably made of conventionally sintered or porous metal having a relatively high pressure drop thereacross for ensuring uniform flow along the entire axial length of the thermal bed 40.

As shown in FIG. 4, the housing 38 includes a first inlet 38*a* disposed in flow communication with the propellant tank 28 through a suitable conduit for selectively channeling a propellant charge 30*c* into the outer chamber 48*a* on the outside of the thermal bed 40 as required. A first outlet 38*b* is disposed in flow communication with the barrel loading end 16*a* through a suitable conduit for selectively channeling thereto the heated propellant charge 30*h* received from the inner chamber 46*a* on the inside of the thermal bed 40 after flowing through the bed 40. A second inlet 38*c* is disposed in flow communication with the heater 34 through a suitable conduit for periodically and selectively channeling the combustion gases 36 therefrom to the inner chamber 46*a* inside the thermal bed 40. And a second outlet 38*d* is disposed in flow communication with the outer chamber 48*a* outside the bed 40 for periodically and selectively discharging to the atmosphere the cooled combustion gases 36 from the housing 38 after flowing through the bed 40.

Suitable means for controlling flow through the thermal tank 32 include a first valve 50*a* disposed in flow communication between the propellant tank 28 and the first inlet 38*a* of the thermal tank 32; a second valve 50*b* disposed in flow communication between the first outlet 38*b* of the thermal tank 32 and the barrel loading end 16*a*; a third valve 50*c* disposed in flow communication between the second inlet 38*c* of the thermal tank 32 and the heater 34; and a fourth valve 50*d* disposed in flow communication with the second outlet 38*d* of the thermal tank 32 for discharging the combustion gases 36 to the local environment or atmosphere. As shown in FIG. 2, a suitable electrical controller 52, which may simply be a plurality of manually operable switches, but in the exemplary form illustrated is a programmable computer which is operatively joined by suitable electrical lines to all four valves 50*a–d* as well as to the projectile loader 20 for controlling repetitive firing of the projectiles 22 from the barrel 16.

As shown in FIG. 4, heating or recharging of the thermal tank 32 occurs by suitably closing the first inlet and outlet valves 50*a,b* and opening the second inlet and outlet valves 50*c,d* to allow the hot combustion gases 36 shown in dashed line to flow into the inner chamber 46*a* and in turn through the porous inner tube 46, through the thermal storage bed 40 heating the material thereof, and through the outer tube 48 into the outer chamber 48*a* for discharge from the housing 38 to the atmosphere through the second outlet 38*d* and the fourth valve 50*d*. Once the thermal storage bed 40 is suitably heated, the third and fourth valves 50*c,d* are closed for allowing repetitive firing of the barrel 16 by repetitive, sequential delivery of the propellant charges 30*c* into the chamber 46*a* as the inlet valve 50*a* is repetitively opened.

In one firing cycle, the second valve 50*b* is initially closed, and the first valve 50*a* is temporarily opened for allowing a single propellant charge 30*c* to flow into the outer chamber 48*a* and radially inwardly through the outer tube 48 and in turn through the thermal storage bed 40 wherein it is heated thereby and continues to flow radially inwardly through the inner tube 46 into the inner chamber 46*a* for forming the heated propellant charge 30*h* therein. As shown in FIG. 3, one of the projectiles 22 is correspondingly loaded into the barrel 16, and upon opening the second valve 50*b*, the heated and pressurized propellant 30*h* enters the barrel 16 for accelerating the projectile 22 to hypervelocity for thereby firing the projectile 22 against the workpiece 12.

After firing the projectile 22, the second valve 50*b* is closed, and the first valve 50*a* is opened for admitting another charge into the thermal tank 32 while the loader 20 positions the next projectile 22 into the gun barrel 16. In this way, the cutting machine 14 is effective for repetitively loading projectiles 22 into the gun barrel 16; repetitively supplying the pressurized propellant charge 30*c* to the gun barrel 16 for respective ones of the projectile 22; repetitively heating the propellant charges 30*c* for respective ones of the projectiles 22 prior to delivery to the gun barrel 16; and repetitively firing the gun barrel 16 by delivering the heated propellant charge 30*h* into the barrel 16 for propelling the projectiles 22 against the workpiece 12 at hypervelocities greater than about 914 m/s. The thermal tank 32 may be sized as desired for allowing rapid firing of a substantial number of the projectiles 22 prior to requiring recharging thereof. The firing may be temporarily halted during recharging of the thermal storage bed 40 which may be readily accomplished using the high temperature combustion gases 36 from the heater 34.

The projectiles 22 may be fired at various energy levels as desired for obtaining variable impact cutting of the same or different workpieces. By selectively varying the volume, pressure, and/or temperature of the heated propellant charge 30*h*, its energy may be correspondingly varied for varying the impact energy of the fired projectile 22. The controller 52 may be suitably adjusted by an operator to vary these firing parameters within the thermal bed 32 for providing the desired heated propellant charge 30*h* to the barrel 16.

Referring again to FIG. 2, the gun barrel 16 preferably includes a conventional silencer 54 such as those used for conventional powder guns which is disposed at the barrel firing end 16*b* for reducing noise therefrom during operation. Since each projectile 22 is fired with sufficient energy to penetrate the concrete workpiece 12 to a substantial distance, it is desirable to contain the scattering of debris therefrom. Accordingly, a containment or scatter shield 56 is suitably sealingly joined at its proximal end around the barrel firing end 16*b*, or around the silencer 54 as illustrated in FIG. 2, and is open at its distal end for contacting the workpiece 12 to contain debris therefrom upon firing of the projectile 22. In an exemplary embodiment, the scatter shield 56 may be formed of Kevlar brand structural fiber in a fabric form for containing the debris.

When the cutting machine 14 is utilized for razing the radioactive hot cell 10, it is also desirable to contain dust produced by the cutting operation since much of such dust is radioactive and the dispersion thereof is undesirable. Accordingly, the cutting machine 14 as illustrated in FIG. 2 may further include a flexible skirt 58 sealingly joined at its proximal end around the barrel firing end 16*b*, or around the silencer 54 illustrated in FIG. 2, and has an open distal end for contacting the workpiece 12 to contain dust debris therefrom upon firing of the projectile 22. The distal end perimeter of the skirt 58 provides an effective seal with the surface of the workpiece 12, and the skirt 58 is preferably disposed in flow communication with means in the exemplary form of a vacuum pump 60 for evacuating the skirt 58 for removing therefrom debris dust generated upon firing of particles 22. A suitable filter 62, such as a conventional HEPA filter, is disposed between the skirt 58 and the pump 60 for trapping and removing any radioactive dust particles withdrawn from the skirt 58 during operation. The skirt 58 may be formed of a suitable elastomeric material, and in the embodiment illustrated in FIG. 2 circumferentially surrounds and is spaced from the inner scatter shield 56. In alternate embodiments, the scatter shield 56 and the flexible skirt 58 may be combined if desired.

Figure 5:
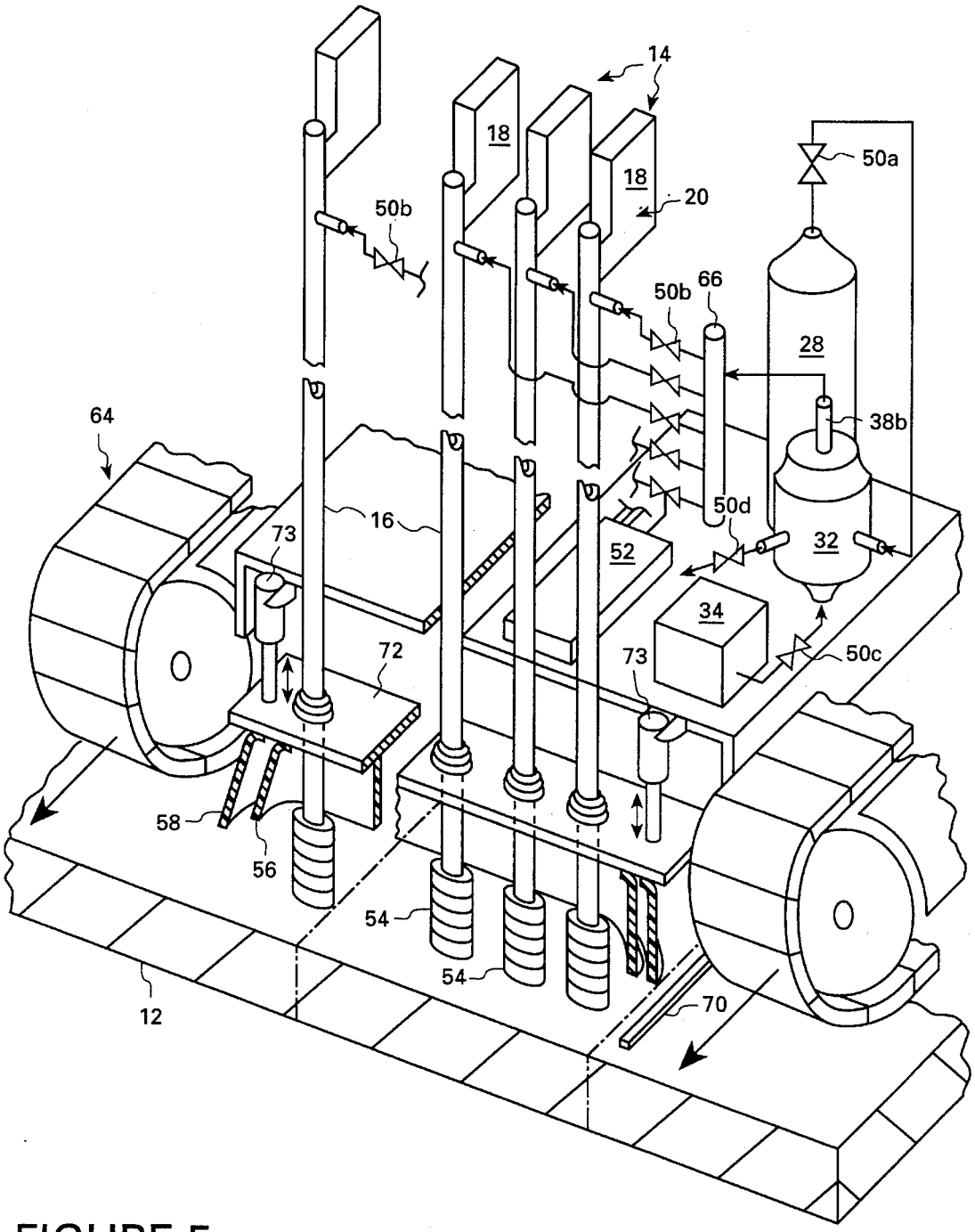
FIG. 5 is an exemplary embodiment of a tracked vehicle carrying a plurality of the gun barrels illustrated in FIG. 2.

Although the cutting machine 14 as illustrated schematically in FIG. 2 may have a single gun barrel 16, FIG. 5 illustrates a preferred embodiment having a plurality of the gun barrels 16 and respective magazines 18 and loaders 20 colinearly aligned and predeterminedly spaced apart from each other, and collectively supported on a tracked vehicle 64. The vehicle 64 may be similar to a conventional bulldozer having a suitable propulsion system and control for carrying the several cutting machines 14 over the surface of the workpiece 12 for selective translation movement thereof. In this embodiment, the several gun barrels 16 may be operatively joined in parallel to common or single ones of the propellant tank 28 and the thermal storage tank 32 for reducing the number of components required for the collective assembly.

Furthermore, a common heater 34 may be used to provide recharging of the thermal storage tank 32, and a single controller 52 may be configured for suitably operating all of the respective cutting machines 14 and their cooperating components. In this embodiment, a supply manifold 66 is suitably joined in flow communication between the first outlet 38*b* of the thermal tank 32 and the respective second valves 50*b*, one each being provided for each of the several gun barrels 16. In this way, the controller 52 is effective for independently firing the gun barrel 16 for forming a selectively variable firing pattern of the projectiles 22 from the barrels 16, including a continuous line pattern from all of the barrels 16 fired simultaneously (which also includes a rapid successive firing), or an interrupted line pattern from firing only selected ones, but not all, of the barrels 16 at a given location of the barrels 16.

Figure 6:
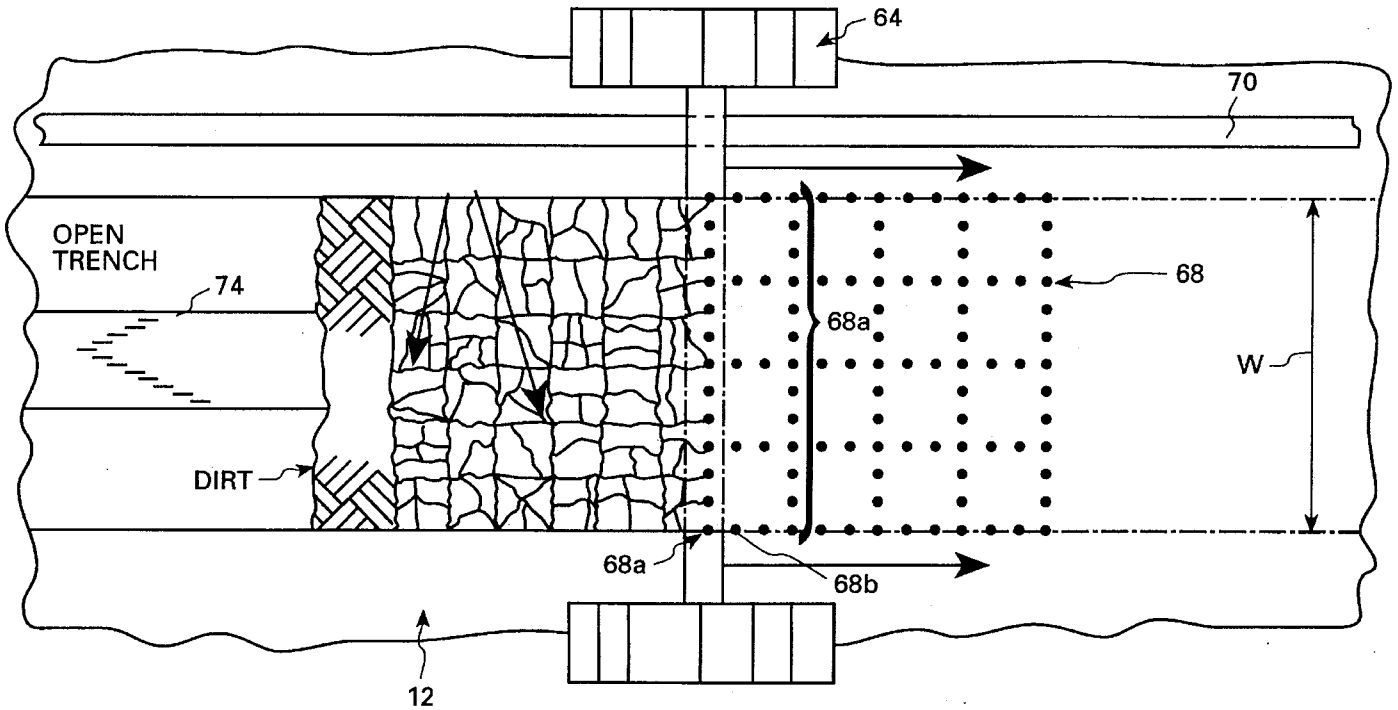
FIG. 6 is a top view of a section of concrete over which the cutting machine vehicle illustrated in FIG. 5 travels for cutting concrete in a predetermined grid firing pattern.

Referring also to FIG. 6, the vehicle 64 is shown from above as moving from left to right in the Figure. A preferred grid pattern 68 for firing of the projectiles 22 is illustrated. With the vehicle 64 stopped at one location, one or more of the individual gun barrels 16 may be fired as desired. In the exemplary firing pattern embodiment illustrated in FIG. 6, thirteen gun barrels 16 are disposed on the vehicle 64 illustrated in FIG. 5 and are colinearly aligned for forming a continuous line pattern 68*a* by firing all thirteen gun barrels 16 simultaneously. In this exemplary embodiment, the gun barrels 16 are spaced apart at about 5 cm for obtaining a collective firing pattern width W of about 60 cm. Each of the projectiles 22 impacts and penetrates the workpiece 12 to a substantial depth in the exemplary range of about 15–40 cm in concrete, with cracking therefrom extending even deeper.

The vehicle 64 is then moved to a next desired position, which in the exemplary embodiment illustrated in FIG. 6 is the same as the unit spacing between the individual gun barrels 16 or about 5 cm, for example. At this location, only selected ones, but not all, of the gun barrels 16 are fired for producing the exemplary interrupted pattern 68*b* shown, with every third gun barrel 16 being fired and every other two adjacent gun barrels not being fired. The vehicle 64 is again moved another unit spacing for repeating the interrupted pattern 68*b* a second time. The vehicle 64 is yet again moved a unit spacing for completing one grid by firing all of the barrels 16 to repeat the line pattern 68*a*.

In this way, a generally square grid pattern is produced with four projectiles impacting per side and no projectiles impacting within each grid unit. The process is repeated as the vehicle 64 travels so that a substantially uniform trench may be formed which will contain rubblized debris or concrete which may be readily removed therefrom. The specific configuration of the grid pattern 68 determines the size of the debris produced and is preferably selected for minimizing the production of debris dust while obtaining suitably large debris chunks for convenient removal from the trench. The firing pattern illustrated in FIG. 6 is illustrative only, and a very wide variety of other firing patterns may also be employed.

As shown in FIGS. 5 and 6, a suitable guide tape 70 may be placed along the workpiece 12 so that the vehicle 64 may follow its path automatically. A suitable sensor is provided on the vehicle 64 to follow the guide tape 70, with the controller 52 being effective for synchronizing firing of the barrels 16 relative to movement of the vehicle 64 for obtaining the predetermined grid firing pattern 68 upon successive firings of the barrels 16. In this way, the vehicle 64 and barrels 16 may be operated automatically, and by remote control if desired.

As shown in FIG. 5, a common scatter shield 56, and a common skirt 58 may surround all of the gun barrels 16 and may be suitably attached to a platform 72 which is selectively raised and lowered by suitable hydraulic actuators 73 at each firing location.

In a preferred embodiment, the vehicle 64 supports thirteen gun barrels 16 with six of the gun barrels 16 being joined to one set of the propellant tank 28, thermal tank 32, and heater 34; and the remaining seven barrels 16 being joined to an identical set thereof (not shown). A trench having a substantial width W, 60 cm for example, may be formed with a linear rate of travel and cutting by the vehicle 64 of up to about 3 meters per minute.

The workpiece 12 illustrated in FIGS. 5 and 6 may form a section of the radioactive hot cell 10 illustrated in FIG. 1, and therefore, collection of dust debris produced upon firing of the projectiles 22 is desired by incorporating in the machine 14 the pump 60 and filter 62 illustrated in FIG. 2. In the embodiment illustrated in FIG. 6, the vehicle 64 may carry the gun barrels 16 for opening a trench in a concrete road for obtaining access to a pipe 74 buried thereunder. The gun barrels 16 may be readily adapted for use in various other cutting applications as desired.

Figure 7:
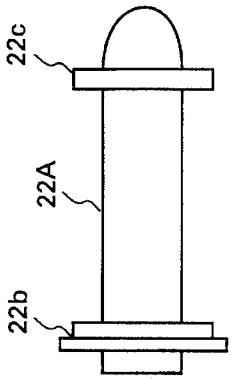
FIG. 7 is a side view of an alternate embodiment of a projectile for use in the gun barrels illustrated in Figures 2 and 3.

In razing of the radioactive hot cell 10 described above, it is desirable to firstly remove solely a small depth of less than about 25 mm from the surface of the concrete workpiece 12 which is the most radioactive. Accordingly, a suitably smaller and lighter projectile designated 22A, as illustrated in FIG. 7, may be used wherein the pointed end thereof is blunt in the form of a parabola, hemisphere or other suitable shape. The volume, pressure, and temperature of the propellant 30 may be suitably varied so that the energy of the impacting projectile 22A against the workpiece 12 is sufficiently low for merely penetrating only the top surface thereof. Once the top surface of the workpiece 12 is broken and then removed, the standard larger projectiles 22 may be loaded into the guns 16 and fired at the higher energies required for deeply penetrating the remainder of the workpiece 12 for the cutting thereof. Variously sized projectiles 22 may be fired at various energy levels and various rates by simple adjustments in the controller 52, without the need for different apparatus specifically configured therefor.

Accordingly, a remotely controlled cutting and travelling apparatus may be provided for dismembering radioactive, reinforced concrete structures. It provides safe, quite, fast cutting of reinforced concrete in a predetermined pattern of cuts to produce readily disposable rubble. And, it provides a variable impact cutting machine with evacuated dust confining means and sound muffling and shielding to protect machine operators and others near the cutting operation.

Figure 8:
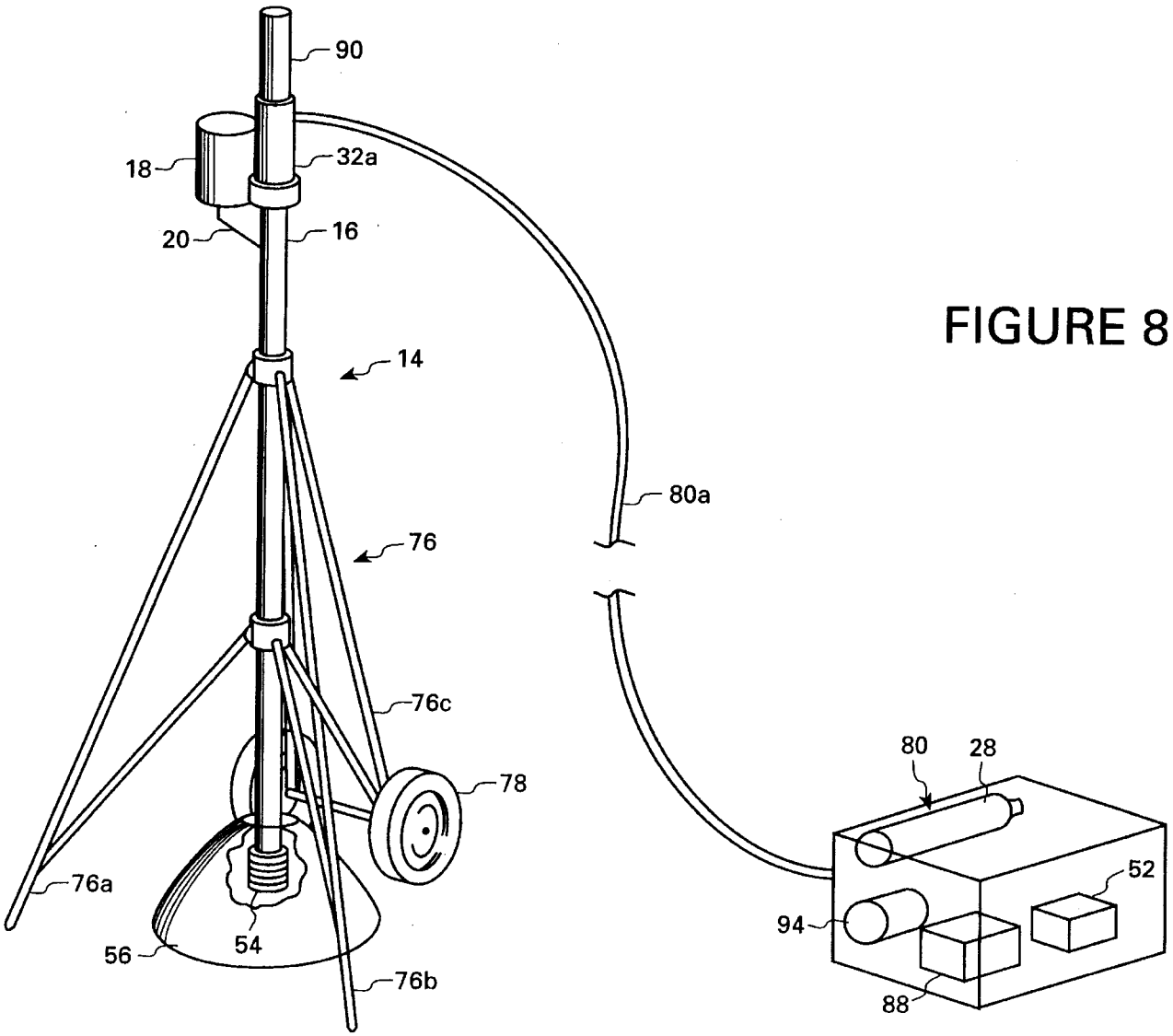
FIG. 8 is a perspective view of an alternate embodiment of a cutting machine having a manually portable gun barrel.

Illustrated in FIG. 8 is a cutting machine 14 having a single gun barrel 16 configured for being manually portable for readily moving the barrel 16 to different locations as desired. In this embodiment, means in the exemplary form of a tripod 76 are attached to the barrel 16 and include first and second legs 76*a,b* which are stationary relative to the barrel 16, and a third leg 76*c* having a pair of wheels 78 rotatably joined to a bottom end thereof for rolling the tripod 76 and the barrel 16 upon tilting of the tripod 76 relative to the third leg 76*c* thereof. A portable supply unit 80 contains the propellant tank 28 among other required components and is suitably joined to the gun barrel 16 by a flexible supply line 80*a*.

Figure 9:
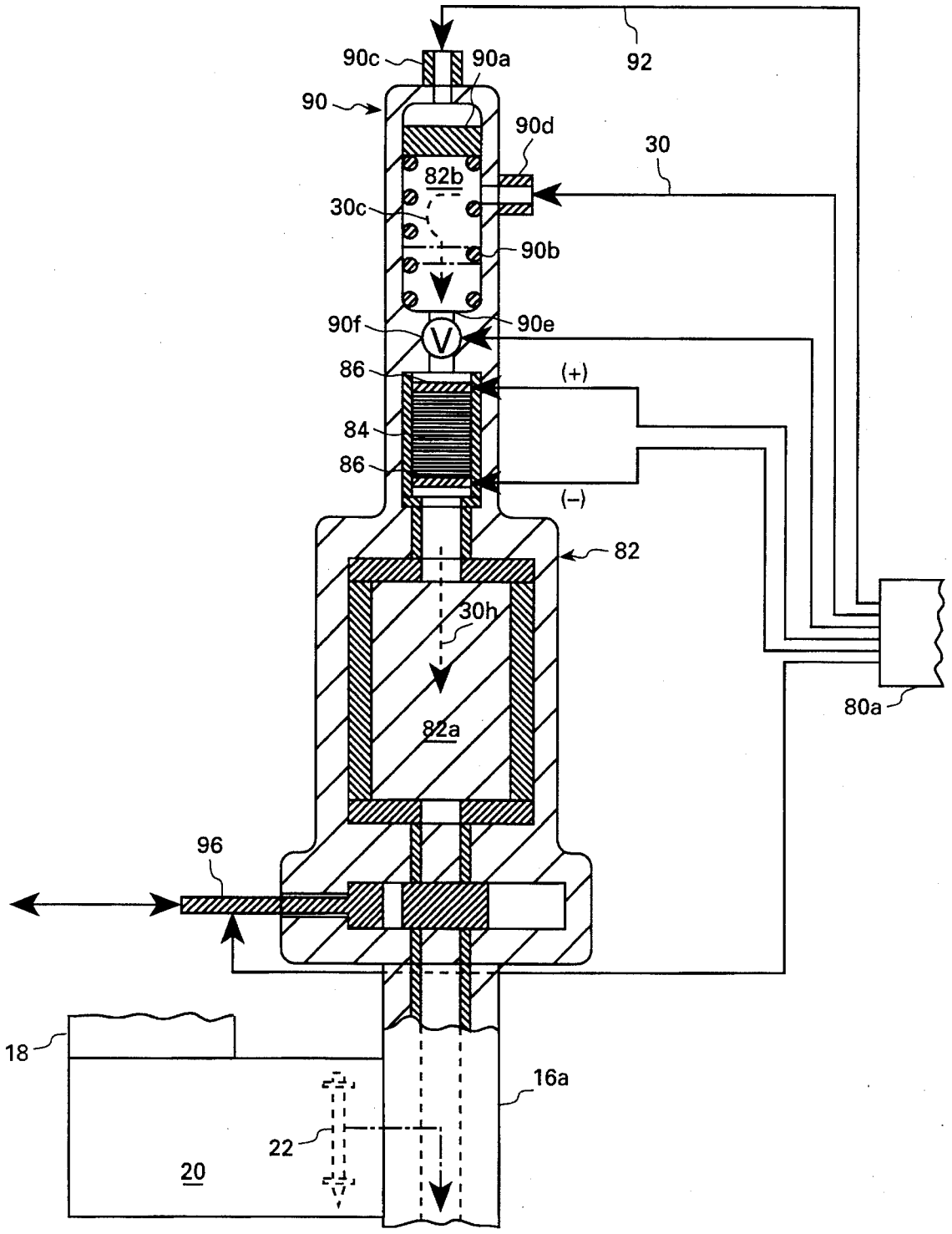
FIG. 9 is an elevational, partly schematic sectional view of the loading end of the gun barrel illustrated in FIG. 8.

FIG. 9 illustrates in more particularity the loading end 16*a* of the gun barrel 16 illustrated in FIG. 8 wherein the thermal storage tank, designated 32A, is integrally formed therewith. The thermal tank 32A includes an elongate housing 82 containing therein a thermal storage bed 84 in the form of a plurality of coaxially stacked together perforated thermal disks which may be either graphite or silicon carbide for example, having a suitably high density of holes therethrough, each hole being about 0.25 mm in diameter so that the disks are effectively porous for channeling therethrough fluid flow.

In order to suitably heat the thermal bed 84, means in the exemplary form of a pair of axially spaced apart tungsten electrodes 86 are provided between which are stacked the disks of the thermal bed 84. The electrodes 86 are porous or perforated to allow flow of the propellant charge 30*c* therethrough. A suitable electrical power supply 88, such as a rechargeable battery pack as shown in Figure 8, is operatively joined to the electrodes 86 for providing electrical power thereto and obtaining resistance heating of the disks of the thermal bed 84 therebetween. One of the electrodes 86 forms a cathode and the other electrode 86 forms an anode which together with the bed disks 84 form an electrical path for electrical resistance heating upon receiving power from the power supply 88. In the embodiment illustrated in FIG. 9, the housing 82 of the thermal tank 32A includes a reservoir 82*a* disposed in flow communication with the thermal bed 84 for storing the heated propellant charge which is heated as it flows through the electrodes 86 and disks 84.

In this exemplary embodiment, a pressure booster 90 is disposed in flow communication between the propellant tank 28 and the thermal storage tank 32A for boosting the pressure of the propellant 30 prior to its flow through the thermal storage bed 84. The pressure booster 90 includes a chamber 82*b* which is preferably an integral, coaxial portion of the housing 82 in which is disposed a piston 90*a* and a suitable return spring 90*b* therefor. At the top end of the booster chamber 82*b* is disposed a booster inlet 90*c* for channeling a pressurized booster fluid 92 such as a hydraulic fluid against one side of the piston 90*a*. A propellant inlet 90*d* is disposed in flow communication between the booster chamber 82*b* and the propellant tank 28 for channeling the propellant 30 into the booster chamber 82*b* as the propellant charge 30*c* against an opposite side of the piston 90*a*. A propellant outlet 90*e* is disposed in flow communication between the booster chamber 82*b* and the thermal storage tank 32A for discharging the propellant at an elevated pressure as the piston 90*a* translates to pressurize the propellant charge 30*c* upon receipt of the booster fluid 92 thereagainst.

As shown in FIG. 8, a suitable hydraulic pump 94 is contained in the portable supply unit 80 and is disposed in flow communication with the booster inlet 90*c* through the supply line 80*a*. In this way, the room temperature pressurized propellant 30 may be admitted into the booster 90 and further pressurized by using the pressurized booster fluid 92 to power the piston 90*a* to compress the propellant charge 30*c* for flow through the thermal tank 32A. A suitably controlled booster valve 90*f* is disposed between the booster chamber 82*b* and the thermal tank 32A and is initially closed as the propellant charge 30*c* is pressurized within the booster 90. The valve 90*f* is suitably opened by the controller 52 which allows the pressurized propellant charge 30*c* to flow through the valve 90*f* and through the porous or perforated electrodes 86 and in turn through the porous disks of the thermal storage bed 84 for extracting thermal energy therefrom. The heated propellant charge 30*h* is then discharged into the reservoir 82*a* for awaiting firing. A suitably actuated slide valve 96 is disposed at the bottom of the housing 82 and selectively controls discharge of the heated and pressurized propellant from the reservoir 82*a* into the gun barrel loading end 16*a*. When the slide valve 96 is open, the projectile 22 positioned in loading end 16*a* is fired from the barrel 16. The firing cycle is repeated as desired at a suitable rate for obtaining rapid cutting of the workpiece 12.

Accordingly, the portable gun barrel 16 illustrated in FIGS. 8 and 9 is particularly useful for cutting horizontal or sloping workpieces. If desired, the gun barrel 16 may be suitably pivotally mounted to a frame (not shown) for allowing selective aiming of the barrel 16 toward non-horizontal workpieces.

The cutting machines 14 described above are effective for obtaining relatively quick cutting of concrete workpieces 12 by using hypervelocity projectiles to penetrate and crack concrete into debris which may be removed. The resulting machine is relatively safe and quiet and provides improvement over conventional apparatus for cutting concrete. Although concrete may be cut using the machine 14, other materials may be suitably cut utilizing the machine as disclosed, or in alternate configurations. The machine 14 may be used in conjunction with the radioactive hot cell 10 disclosed above, or may be used for road and bridge repair, tunneling, mining, and as otherwise desired.

Figure 10:
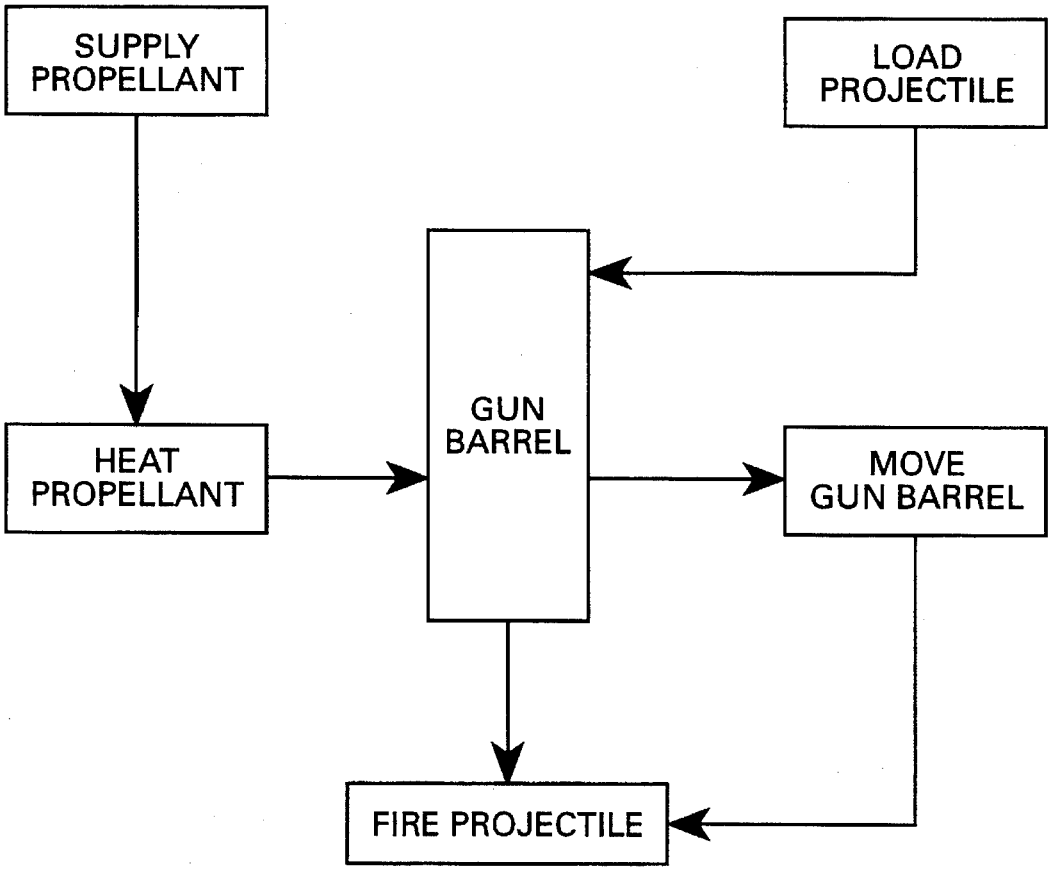
FIG. 10 is a flowchart representation of a basic method of using the cutting machines of the present invention.

A basic flowchart of the methods discussed above which may be practiced using the various embodiments of the cutting machines 14 is illustrated in FIG. 10.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A machine 14 for cutting a workpiece 12 comprising:

an elongate gun barrel 16 having a loading end 16*a* and an opposite firing end 16*b;* means 18, 20 for repetitively and sequentially supplying projectiles 22 into said barrel loading end 16*a;* a tank 28 for storing a pressurized propellant 30;

a thermal storage tank 32,32A joined in flow communication with said propellant tank 28 for repetitively receiving therefrom a propellant charge 30*c* and heating said propellant charge 30*c*, said thermal tank 32 also being joined in flow communication with said barrel loading end 16*a* for delivering said heated propellant charge 30*h* thereto; and means 50, 52 for controlling repetitive delivery of said projectiles 22 to and loading into said barrel 16, said propellant charge 30*c* from said propellant tank 28 to said thermal tank 32, and said heated propellant charge 30*h* from said thermal tank 32 to said barrel 16 for repetitively firing said projectiles 22 from said barrel firing end 16*b* toward said workpiece 12 for cutting thereof.

2. A machine according to claim 1 wherein said thermal storage tank 32 includes a porous thermal storage bed 40,84 for storing heat and releasing said heat into said propellant charge 30*c* upon flow therethrough; and said machine 14 further comprises means 34,86,88 for periodically heating said bed 40,84 after a plurality of said propellant charges 30*c* remove a predetermined amount of heat therefrom.

3. A machine according to claim 2 wherein said gun barrel 16 includes a silencer 54 disposed at said barrel firing end 16*b* for reducing noise therefrom.

4. A machine according to claim 3 further comprising:

a skirt 58 sealingly joined at a proximal end thereof around said barrel firing end 16*b*, and being open at a distal end for contacting said workpiece 12 to contain debris therefrom upon firing of said projectiles 22; and means 60 for evacuating said skirt 58 for removing therefrom debris dust generated upon firing of said projectiles 22.

5. A machine according to claim 3 further comprising a scatter shield 56 sealingly joined at a proximal end thereof around said barrel firing end 16*b*, and being open at a distal end for contacting said workpiece 12 to contain debris therefrom upon firing of said projectiles 22.

6. A machine according to claim 5 wherein said projectile supplying means comprise:

a magazine 18 for storing a plurality of said projectiles 22; and a loader 20 operatively joined to said magazine 18 and said barrel loading end 16*a* for repetitively loading said projectiles 22 in turn into said barrel loading end 16*a*.

7. A machine according to claim 5 wherein said controlling means comprise:

a first valve 50*a* disposed in flow communication between said propellant tank 28 and said thermal tank 32;

a second valve 50*b* disposed in flow communication between said thermal tank 32 and said barrel loading end 16*a*; and a controller 52 operatively joined to said first and second valves 50*a,b* and to said projectile supplying means for controlling repetitive firing of said projectiles 22 from said barrel 16.

8. A machine according to claim 5 wherein:

said bed heating means comprise a heater 34 in the form of a combustion burner for generating hot combustion gases 36; and said thermal storage tank 32 further includes a housing 38 containing said thermal storage bed 40, said housing 38 including a first inlet 38*a* disposed in flow communication with said propellant tank 28 for selectively channeling said propellant charge 30*c* to an outside of said bed 40; a first outlet 38*b* disposed in flow communication with said barrel loading end 16*a* for selectively channelling thereto said heated propellant charge 30*h* received from inside of said bed 40 after flowing through said bed 40; a second inlet 38*c* disposed in flow communication with said heater 34 for selectively channelling said combustion gases 36 therefrom to said bed inside; and a second outlet 38*d* disposed in flow communication with said bed outside for selectively discharging said combustion gases 36 from said housing 38 after flowing through said bed 40.

9. A machine according to claim 8 further comprising:

a first valve 50*a* disposed in flow communication between said propellant tank 28 and said thermal tank first inlet 38*a;* a second valve 50*b* disposed in flow communication between said thermal tank first outlet 38*b* and said barrel loading end 16*a;* a third valve 50*c* disposed in flow communication between said thermal tank second inlet 38*c* and said heater 34; and a fourth valve 50*d* disposed in flow communication with said thermal tank second outlet 38*d* for discharging said combustion gases 36 to atmosphere.

10. A machine according to claim 9 further comprising:

a plurality of said gun barrels 16 and respective projectile loading means 18, 20 colinearly aligned and predeterminedly spaced apart from each other;

said gun barrels 16 being operatively joined in parallel to common ones of said propellant tank 28 and said thermal storage tank 32; and said controlling means being effective for independently firing said gun barrels 16 for forming a selectively variable firing pattern of said projectiles 22 from said barrels 16 including a continuous pattern from all said barrels 16 or an interrupted pattern from only selected ones, but not all, of said barrels 16.

11. A machine according to claim 10 further comprising a vehicle 64 supporting said gun barrels 16 for selective movement thereof; and said controlling means are effective for synchronizing firing of said barrels 16 relative to movement of said vehicle 64 for obtaining a predetermined grid firing pattern 68 upon successive firings of said barrels 16.

12. A machine according to claim 5 wherein:

said thermal storage tank 32A further includes a housing 82 containing said thermal storage bed 84 in the form of a plurality of coaxially stacked, perforated thermal disks; and said bed heating means comprise a pair of spaced apart electrodes 86 between which are stacked said thermal disks, and a power supply 88 operatively joined to said electrodes 86 for providing electrical power thereto for obtaining resistance heating of said disks therebetween.

13. A machine according to claim 12 wherein said thermal storage tank 32A further includes a reservoir 82*a* disposed in flow communication with said thermal storage bed 84 for storing said heated propellant charge 30*h* received therefrom.

14. A machine according to claim 13 further comprising means for manually moving said gun barrel 16 to different locations.

15. A machine according to claim 14 wherein said moving means comprises a tripod 76 joined to said gun barrel 16 for manually moving said barrel 16 to different locations, said tripod 76 including first and second stationary legs 76*a,b* and a third leg 76*c* having a pair of wheels 78 rotatably joined to an end thereof for rolling said barrel 16.

16. A machine according to claim 5 further comprising a pressure booster 90 disposed in flow communication between said propellant tank 28 and said thermal storage tank 32A and comprising:

a chamber 82*b* having a piston 90*a* disposed therein;

a booster inlet 90*c* disposed at one end of said booster chamber 82*b* for channeling a pressurized booster fluid 92 against one side of said piston 90*a;* a propellant inlet 90*d* disposed in flow communication between said booster chamber 82*b* and said propellant tank 28 for channeling said propellant charge 30*c* into said booster chamber 82*b* against an opposite side of said piston 90*a*; and a propellant outlet 90*e* disposed in flow communication between said booster chamber 82*b* and said thermal storage tank 32A for discharging said propellant charge 30*c* at an elevated pressure as said piston 90*a* translates to pressurize said propellant charge upon receipt of said booster fluid 92 thereagainst.

17. A machine according to claim 16 further comprising a pump 94 for selectively injecting said booster fluid into said booster chamber 82*b* against said piston 90*a*.

18. A machine according to claim 5 wherein each of said projectiles 22 comprises:

a cylindrical rod 22*a*; and a pair of spaced apart sabots 22*b,c* fixedly joined to said rod 22*a*.

19. A machine according to claim 18 wherein said rod 22*a* has a pointed distal end.

20. A machine according to claim 5 wherein said thermal storage tank 32 is effective for heating said propellant charge 30*c* to a predetermined pressure for firing said projectile at a hypervelocity greater than about 914 meters per second.

21. A machine 14 as defined in claim 1, in combination with a projectile 22 for being fired at hypervelocity from said gun barrel 16, said projectile comprising:

a cylindrical rod 22*a*; and a pair of spaced apart sabots 22*b* fixedly joined to said rod 22*a*.

22. A projectile according to claim 21 wherein said rod 22*a* has a pointed distal end.

23. A projectile according to claim 22 wherein said rod 22*a* is metal and said sabots 22 are plastic.

24. A projectile according to claim 23 weighing less than about 2.5 grams.

25. A method of cutting workpiece 12 comprising:

(a) repetitively operating a loader 20 to load projectiles 22 into a gun barrel 16 while a propellant charge 30*c* is admitted into a thermal storage tank 32, and while the propellant charge is temporarily prevented from entering the gun barrel;

(b) repetitively supplying a pressurized propellant charge 30*c* from said thermal storage tank to said gun barrel 16 for respective ones of said projectiles 22;

(c) repetitively heating said propellant charges 30*c* for respective ones of said projectiles 22 prior to delivery to said gun barrel 16; and (d) repetitively firing said gun barrel 16 for propelling said projectiles 22 against said workpiece 12 at hypervelocity greater than about 914 meters per second by respectively releasing said heated propellant charges 30*h* into said barrel 16.

26. A method according to claim 25 further comprising:

(e) simultaneously selectively firing projectiles toward said workpiece 12 from a plurality of said gun barrels 16 to obtain a selectively variable firing pattern; and (f) moving said gun barrels 16 to another position and repeating step (e) for obtaining a predetermined grid firing pattern upon successive firings of said barrel 16.

27. A method according to claim 26 wherein said workpiece is a concrete slab 12, and said grid firing pattern produces generally square grids for sectioning said slab 12 into removable pieces.

28. A method according to claim 27 wherein said concrete slab is a section of a radioactive hot cell 10, and further comprising the step of capturing dust debris produced upon firing of said projectiles 22.

29. A method according to claim 25 further comprising selectively varying energy of said heated propellant charge 30*h* for correspondingly varying impact energy of said projectiles 22.

30. A method according to claim 29 wherein pressure of said heated propellant charge 30*h* is varied for varying said projectile impact energy.

31. A method according to claim 25 wherein said propellant charge 30*c* is helium and is heated to about 1500° K. for achieving a pressure of about 84 MPa.

* * * * *